US009817428B2

(12) United States Patent
Fronczak et al.

(10) Patent No.: US 9,817,428 B2
(45) Date of Patent: Nov. 14, 2017

(54) CURRENT-MODE BANDGAP REFERENCE WITH PROPORTIONAL TO ABSOLUTE TEMPERATURE CURRENT AND ZERO TEMPERATURE COEFFICIENT CURRENT GENERATION

(71) Applicant: Synaptics Incorporated, San Jose, CA (US)

(72) Inventors: Kevin Fronczak, Penfield, NY (US); Eric Bohannon, Henrietta, NY (US)

(73) Assignee: Synaptics Incorporated, San Jose, CA (US)

( * ) Notice: Subject to any disclaimer, the term of this patent is extended or adjusted under 35 U.S.C. 154(b) by 182 days.

(21) Appl. No.: 14/788,529

(22) Filed: Jun. 30, 2015

(65) Prior Publication Data

US 2016/0349786 A1 Dec. 1, 2016

Related U.S. Application Data

(60) Provisional application No. 62/168,587, filed on May 29, 2015.

(51) Int. Cl.
*G05F 3/26* (2006.01)

(52) U.S. Cl.
CPC ..... *G05F 3/267* (2013.01)

(58) Field of Classification Search
CPC ..... G05F 3/267
See application file for complete search history.

(56) References Cited

U.S. PATENT DOCUMENTS 6,344,762 B1 * 2/2002 Prentice ..... H03F 3/45556 327/307
6,614,293 B1 * 9/2003 Sauer ..... G05F 3/265 327/538
7,119,527 B2 * 10/2006 Fernald ..... G05F 3/262 323/313
7,541,862 B2 * 6/2009 Fujisawa ..... G05F 3/30 323/313
8,085,029 B2 * 12/2011 Dobkin ..... G05F 3/30 323/314
8,710,812 B1 * 4/2014 Edwards ..... G05F 1/56 323/281

(Continued)

OTHER PUBLICATIONS

Banba, et al., "A CMOS Bandgap Reference Circuit with Sub-1-V Operation", IEEE Journal of Solid-Stat Circuits, vol. 34, No. 5, May 1999, 670-674.

*Primary Examiner* — Emily P Pham
(74) *Attorney, Agent, or Firm* — Osha Liang LLP

(57) ABSTRACT

In a current-mode bandgap reference integrated circuit: a bandgap voltage generator is configured to generate a bandgap voltage, a zero-temperature coefficient current generator configured to generate a zero-temperature coefficient current, and a proportional to absolute temperature current generator configured to generate a proportional to absolute temperature current. The integrated circuit includes a first pair of bipolar junction transistors (BJT) comprising a first BJT and a second BJT. The integrated circuit also includes a second pair of bipolar junction transistors, comprising a third BJT and a fourth BJT. The first pair of BJTs matches the second pair of BJTs.

18 Claims, 7 Drawing Sheets

(56) References Cited

U.S. PATENT DOCUMENTS

| | | | | |
|---|---|---|---|---|
| 8,970,188 | B2 * | 3/2015 | Ganta | G05F 1/56 323/273 |
| 9,292,113 | B2 * | 3/2016 | Teh | G06F 3/0354 |
| 9,310,817 | B2 * | 4/2016 | Pude | G05F 3/30 |
| 2015/0293552 | A1 * | 10/2015 | Motozawa | G05F 3/30 323/313 |
| 2015/0338872 | A1 * | 11/2015 | Afzal | G05F 3/30 323/313 |

* cited by examiner

CURRENT-MODE BANDGAP REFERENCE WITH PROPORTIONAL TO ABSOLUTE TEMPERATURE CURRENT AND ZERO TEMPERATURE COEFFICIENT CURRENT GENERATION

CROSS REFERENCE TO RELATED APPLICATIONS

This application claims priority to and benefit of U.S. provisional patent application 62/168,587, titled "CURRENT-MODE BANDGAP REFERENCE WITH PTAT AND ZTC CURRENT GENERATION," by Kevin Froncz-ak and Eric Bohannon, filed May 29, 2015, and assigned to the assignee of the present non-provisional application, which is herein incorporated by reference in its entirety.

BACKGROUND

Input devices including proximity sensor devices (also commonly called touchpads or touch sensor devices) are widely used in a variety of electronic systems. A proximity sensor device typically includes a sensing region, often demarked by a surface, in which the proximity sensor device determines the presence, location and/or motion of one or more input objects. Proximity sensor devices may be used to provide interfaces for the electronic system. For example, proximity sensor devices are often used as input devices for larger computing systems (such as opaque touchpads integrated in, or peripheral to, notebook or desktop computers). Proximity sensor devices are also often used in smaller computing systems (such as touch screens integrated in cellular phones and tablet computers). Such touch screen input devices are typically superimposed upon or otherwise collocated with a display of the electronic system. Reference voltages and/or currents are utilized in such input devices and/or the processing systems thereof.

SUMMARY

In some embodiments of a current-mode bandgap reference integrated circuit: a bandgap voltage generator is configured to generate a bandgap voltage, a zero-temperature coefficient current generator configured to generate a zero-temperature coefficient current, and a proportional to absolute temperature current generator configured to generate a proportional to absolute temperature current. The integrated circuit includes a first pair of bipolar junction transistors (BJT) comprising a first BJT and a second BJT. The integrated circuit also includes a second pair of bipolar junction transistors, comprising a third BJT and a fourth BJT. The first pair of BJTs matches the second pair of BJTs. The integrated circuit may be included as part of an input device. The integrated circuit may be coupled to or included within a processing system for an input device.

BRIEF DESCRIPTION OF DRAWINGS

The drawings referred to in this Brief Description of Drawings should not be understood as being drawn to scale unless specifically noted. The accompanying drawings, which are incorporated in and form a part of the Description of Embodiments, illustrate various embodiments and, together with the Description of Embodiments, serve to explain principles discussed below, where like designations denote like elements, and.

DESCRIPTION OF EMBODIMENTS

The following Description of Embodiments is merely provided by way of example and not of limitation. Furthermore, there is no intention to be bound by any expressed or implied theory presented in the preceding Background, Summary, or Brief Description of Drawings or the following Description of Embodiments.

Overview of Discussion

Herein, various embodiments are described that provide input devices, processing systems, and circuits that facilitate improved usability. In various embodiments described herein, the input device may be a capacitive sensing input device or another type of input sensing device. Utilizing techniques and circuits described herein, efficiencies may be achieved by a compact bandgap voltage reference circuit that produces a PTAT (proportional-to-absolute-temperature) current and a ZTC (zero temperature-coefficient) current. Conventionally, bandgap voltage reference circuits provide a PTAT current or a ZTC current (but not both). The current that is not provided by the conventional bandgap voltage reference circuit (the ZTC current or the PTAT current) is often generated using many additional components to the point that a significant portion of the circuit is essentially duplicated to provide the additional current. This results in increased power consumption and area consumed by the components in an integrated circuit, and thus increased cost. Herein, a bandgap voltage reference circuit is described that can produce both a PTAT current and a ZTC current with minimal additional components (and thus a minimal increase in power, area, and cost). As will be described, in some embodiments, the architecture can also be slightly modified to operate with a supply voltage ≤1 V (i.e., >0V and ≤1V)), unlike traditional bandgap voltage reference circuits that typically require a supply voltage of at least 1.5 V-1.8 V to function.

Discussion begins with a description of an example input device with which or upon which various embodiments described herein may be implemented. An example sensor electrode pattern is then described. This is followed by description of an example processing system and some components thereof. The processing system may be utilized with or as a portion of an input device, such as a capacitive sensing input device. Several example input devices are described. Various embodiments are described where a current-mode bandgap reference integrated circuit is either included within the processing system or electrically coupled with the processing system. Operation of the input devices, processing systems, current-mode bandgap reference integrated circuits, and components thereof are then further described. The description of the current-mode bandgap reference integrated circuits includes description of various embodiments and components thereof.

Example Input Device

Figure 1:
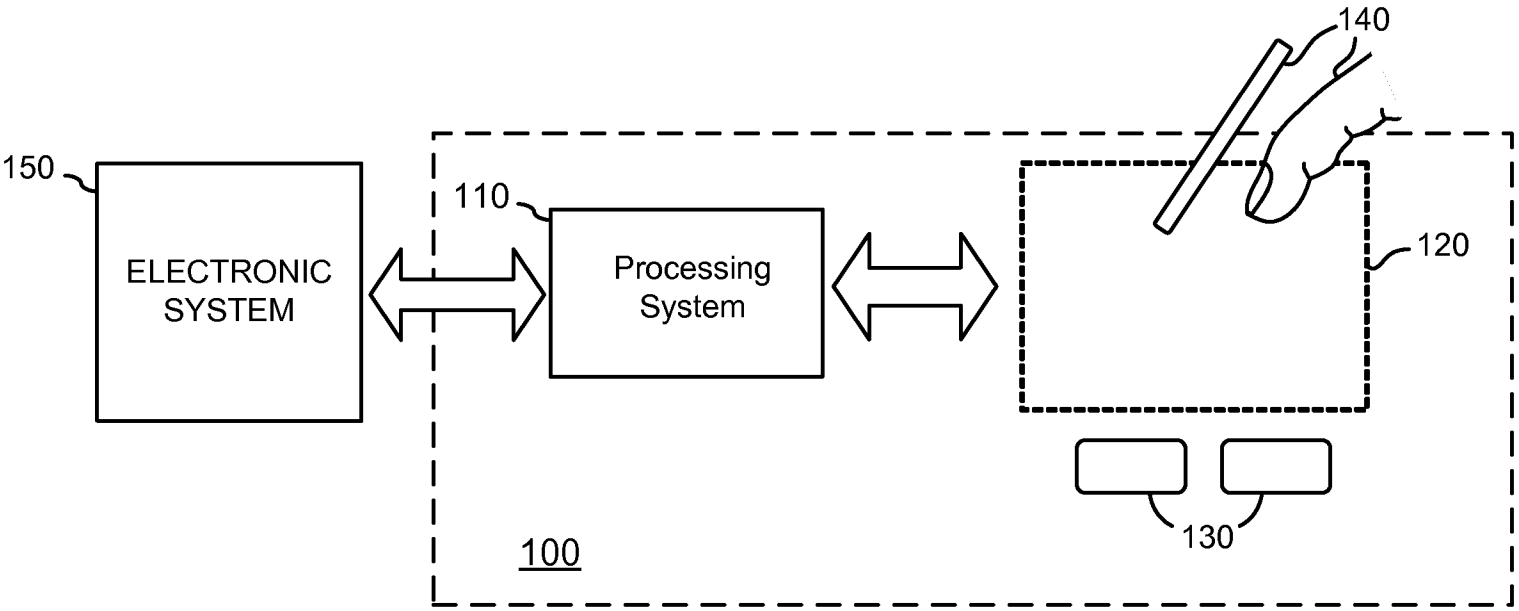
FIG. 1 is a block diagram of an example input device, in accordance with embodiments.

Turning now to the figures, FIG. 1 is a block diagram of an example input device 100, in accordance with various embodiments. Input device 100 may be configured to provide input to an electronic system/device 150. As used in this document, the term "electronic system" (or "electronic device") broadly refers to any system capable of electronically processing information. Some non-limiting examples of electronic systems include personal computers of all sizes and shapes, such as desktop computers, laptop computers, netbook computers, tablets, web browsers, e-book readers, and personal digital assistants (PDAs). Additional example electronic systems include composite input devices, such as physical keyboards that include input device 100 and separate joysticks or key switches. Further example electronic systems include peripherals such as data input devices (including remote controls and mice), and data output devices (including display screens and printers). Other examples include remote terminals, kiosks, and video game machines (e.g., video game consoles, portable gaming devices, and the like). Other examples include communication devices (including cellular phones, such as smart phones), and media devices (including recorders, editors, and players such as televisions, set-top boxes, music players, digital photo frames, and digital cameras). Additionally, the electronic systems could be a host or a slave to the input device.

Input device 100 can be implemented as a physical part of an electronic system 150, or can be physically separate from electronic system 150. As appropriate, input device 100 may communicate with parts of the electronic system using any one or more of the following: buses, networks, and other wired or wireless interconnections. Examples include, but are not limited to: Inter-Integrated Circuit (I2C), Serial Peripheral Interface (SPI), Personal System 2 (PS/2), Universal Serial Bus (USB), Bluetooth®, Radio Frequency (RF), and Infrared Data Association (IrDA).

In FIG. 1, input device 100 is shown as a proximity sensor device (also often referred to as a "touchpad" or a "touch sensor device") configured to sense input provided by one or more input objects 140 in a sensing region 120. Example input objects include fingers and styli, as shown in FIG. 1.

Sensing region 120 encompasses any space above, around, in and/or near input device 100, in which input device 100 is able to detect user input (e.g., user input provided by one or more input objects 140). The sizes, shapes, and locations of particular sensing regions may vary widely from embodiment to embodiment. In some embodiments, sensing region 120 extends from a surface of input device 100 in one or more directions into space until signal-to-noise ratios prevent sufficiently accurate object detection. The distance to which this sensing region 120 extends in a particular direction, in various embodiments, may be on the order of less than a millimeter, millimeters, centimeters, or more, and may vary significantly with the type of sensing technology used and the accuracy desired. Thus, some embodiments sense input that comprises no contact with any surfaces of input device 100, contact with an input surface (e.g., a touch surface) of input device 100, contact with an input surface of input device 100 coupled with some amount of applied force or pressure, and/or a combination thereof. In various embodiments, input surfaces may be provided by surfaces of casings within which the sensor electrodes reside, by face sheets applied over the sensor electrodes or any casings, etc. In some embodiments, sensing region 120 has a rectangular shape when projected onto an input surface of input device 100.

Input device 100 may utilize any combination of sensor components and sensing technologies to detect user input in the sensing region 120. Input device 100 comprises one or more sensing elements for detecting user input. As several non-limiting examples, input device 100 may use acoustic, ultrasonic, capacitive, elastive, resistive, inductive, and/or optical techniques.

Some implementations are configured to provide images that span one, two, three, or higher dimensional spaces. Some implementations are configured to provide projections of input along particular axes or planes.

In some resistive implementations of the input device 100, a flexible and conductive first layer is separated by one or more spacer elements from a conductive second layer. During operation, one or more voltage gradients are created across the layers. Pressing the flexible first layer may deflect it sufficiently to create electrical contact between the layers, resulting in voltage outputs reflective of the point(s) of contact between the layers. These voltage outputs may be used to determine positional information.

In some inductive implementations of the input device 100, one or more sensing elements pick up loop currents induced by a resonating coil or pair of coils. Some combination of the magnitude, phase, and frequency of the currents may then be used to determine positional information.

In some capacitive implementations of input device 100, voltage or current is applied to create an electric field. Nearby input objects cause changes in the electric field, and produce detectable changes in capacitive coupling that may be detected as changes in voltage, current, or the like.

Some capacitive implementations utilize arrays or other regular or irregular patterns of capacitive sensing elements to create electric fields. In some capacitive implementations, separate sensing elements may be ohmically shorted together to form larger sensor electrodes. Some capacitive implementations utilize resistive sheets, which may be uniformly resistive.

Some capacitive implementations utilize "self capacitance" (or "absolute capacitance") sensing methods based on changes in the capacitive coupling between sensor electrodes and an input object. In various embodiments, an input object near the sensor electrodes alters the electric field near the sensor electrodes, thus changing the measured capacitive coupling. In one implementation, an absolute capacitance sensing method operates by modulating sensor electrodes with respect to a reference voltage (e.g., system ground), and by detecting the capacitive coupling between the sensor electrodes and input objects.

Some capacitive implementations utilize "mutual capacitance" (or "transcapacitance") sensing methods based on changes in the capacitive coupling between sensor electrodes. In various embodiments, an input object near the sensor electrodes alters the electric field between the sensor electrodes, thus changing the measured capacitive coupling. In one implementation, a transcapacitive sensing method operates by detecting the capacitive coupling between one or more transmitter sensor electrodes (also "transmitter electrodes" or "transmitters") and one or more receiver sensor electrodes (also "receiver electrodes" or "receivers"). Collectively transmitters and receivers may be referred to as sensor electrodes or sensor elements. Transmitter sensor electrodes may be modulated relative to a reference voltage (e.g., system ground) to transmit transmitter signals. Receiver sensor electrodes may be held substantially constant relative to the reference voltage to facilitate receipt of resulting signals. A resulting signal may comprise effect(s) corresponding to one or more transmitter signals, and/or to one or more sources of environmental interference (e.g., other electromagnetic signals). Sensor electrodes may be dedicated transmitters or receivers, or may be configured to both transmit and receive.

In some embodiments, one or more receiver electrodes may be operated to receive a resulting signal when no transmitter electrodes are transmitting (e.g., the transmitters are disabled). In this manner, the resulting signal represents noise detected in the operating environment of sensing region 120. In this manner, in some embodiments, the resulting signal represents noise detected in the operating environment of sensing region 120. For example, display noise of a nearby or co-located (e.g., overlapping) display may be represented in the resulting signal that is received during transcapacitive sensing.

In FIG. 1, a processing system 110 is shown as part of input device 100. Processing system 110 is configured to operate the hardware of input device 100 to detect input in sensing region 120. Processing system 110 comprises parts of or all of one or more integrated circuits (ICs) and/or other circuitry components. (For example, a processing system for a mutual capacitance (i.e., transcapacitive) sensor device may comprise transmitter circuitry configured to transmit signals with transmitter sensor electrodes, and/or receiver circuitry configured to receive signals with receiver sensor electrodes). In some embodiments, processing system 110 also comprises electronically-readable instructions, such as firmware code, software code, and/or the like. In some embodiments, components composing processing system 110 are located together, such as near sensing element(s) of input device 100. In other embodiments, components of processing system 110 are physically separate with one or more components close to sensing element(s) of input device 100, and one or more components elsewhere. For example, input device 100 may be a peripheral coupled to a desktop computer, and processing system 110 may comprise software configured to run on a central processing unit of the desktop computer and one or more ICs (perhaps with associated firmware) separate from the central processing unit. As another example, input device 100 may be physically integrated in a phone, and processing system 110 may comprise circuits and firmware that are part of a main processor of the phone. In some embodiments, processing system 110 is dedicated to implementing input device 100. In other embodiments, processing system 110 also performs other functions, such as operating display screens, driving haptic actuators, etc.

Processing system 110 may be implemented as a set of modules that handle different functions of processing system 110. Each module may comprise circuitry that is a part of processing system 110, firmware, software, or a combination thereof. In various embodiments, different combinations of modules may be used. Example modules include hardware operation modules for operating hardware such as sensor electrodes and display screens, data processing modules for processing data such as sensor signals and positional information, and reporting modules for reporting information. Further example modules include sensor modules configured to operate sensing element(s) or other structures to detect input and determination modules configured to determine positions of any inputs objects detected. For example, a sensor module may perform one or more of absolute capacitive sensing and transcapacitive sensing to detect inputs, and a determination module may determine positions of inputs based on the detected capacitances or changes thereto. In some embodiments, other modules or functionality may be included in processing system 110; for example, an identification module may be included and configured to identify gestures from detected inputs.

In some embodiments, processing system 110 responds to user input (or lack of user input) in sensing region 120 directly by causing one or more actions. Example actions include changing operation modes, as well as Graphic User Interface (GUI) actions such as cursor movement, selection, menu navigation, and other functions. In some embodiments, processing system 110 provides information about the input (or lack of input) to some part of the electronic system (e.g., to a central processing system of the electronic system that is separate from processing system 110, if such a separate central processing system exists). In some embodiments, some part of the electronic system processes information received from processing system 110 to act on user input, such as to facilitate a full range of actions, including mode changing actions and GUI actions.

For example, in some embodiments, processing system 110 operates the sensing element(s) of input device 100 to produce electrical signals indicative of input (or lack of input) in sensing region 120. Processing system 110 may perform any appropriate amount of processing on the electrical signals in producing the information provided to the electronic system. For example, processing system 110 may digitize analog electrical signals obtained from the sensor electrodes. As another example, processing system 110 may perform filtering or other signal conditioning. As yet another example, processing system 110 may subtract or otherwise account for a baseline, such that the information reflects a difference between the electrical signals and the baseline. As yet further examples, processing system 110 may determine positional information, recognize inputs as commands, recognize handwriting, and the like.

"Positional information" as used herein broadly encompasses absolute position, relative position, velocity, acceleration, and other types of spatial information. As one example, "zero-dimensional" positional information includes near/far or contact/no contact information. As another example, "one-dimensional" positional information includes positions along an axis. As yet another example, "two-dimensional" positional information includes motions in a plane. As still another example, "three-dimensional" positional information includes instantaneous or average velocities in space. Further examples include other representations of spatial information. Historical data regarding one or more types of positional information may also be determined and/or stored, including, for example, historical data that tracks position, motion, or instantaneous velocity over time.

In some embodiments, input device 100 is implemented with additional input components that are operated by processing system 110 or by some other processing system. These additional input components may provide redundant functionality for input in sensing region 120, or some other functionality. FIG. 1 shows buttons 130 near sensing region 120 that can be used to facilitate selection of items using input device 100. Other types of additional input components include sliders, balls, wheels, switches, and the like. Conversely, in some embodiments, input device 100 may be implemented with no other input components.

In some embodiments, input device 100 may be a touch screen, and sensing region 120 overlaps at least part of an active area of a display screen. For example, input device 100 may comprise substantially transparent sensor electrodes overlaying the display screen and provide a touch screen interface for the associated electronic system 150. The display screen may be any type of dynamic display capable of displaying a visual interface to a user, and may include any type of light emitting diode (LED), organic LED (OLED), cathode ray tube (CRT), liquid crystal display (LCD), plasma, electroluminescence (EL), or other display technology. Input device 100 and the display screen may share physical elements. For example, some embodiments may utilize some of the same electrical components for displaying and sensing. As another example, the display screen may be operated in part or in total by processing system 110.

It should be understood that while many embodiments are described in the context of a fully functioning apparatus, the mechanisms are capable of being distributed as a program product (e.g., software) in a variety of forms. For example, the mechanisms that are described may be implemented and distributed as a software program on information bearing media that are readable by electronic processors (e.g., non-transitory computer-readable and/or recordable/writable information bearing media readable by processing system 110). Additionally, the embodiments apply equally regardless of the particular type of medium used to carry out the distribution. Examples of non-transitory, electronically readable media include various discs, memory sticks, memory cards, memory modules, and the like. Electronically readable media may be based on flash, optical, magnetic, holographic, or any other non-transitory storage technology.

Example Sensor Electrode Pattern

Figure 2:
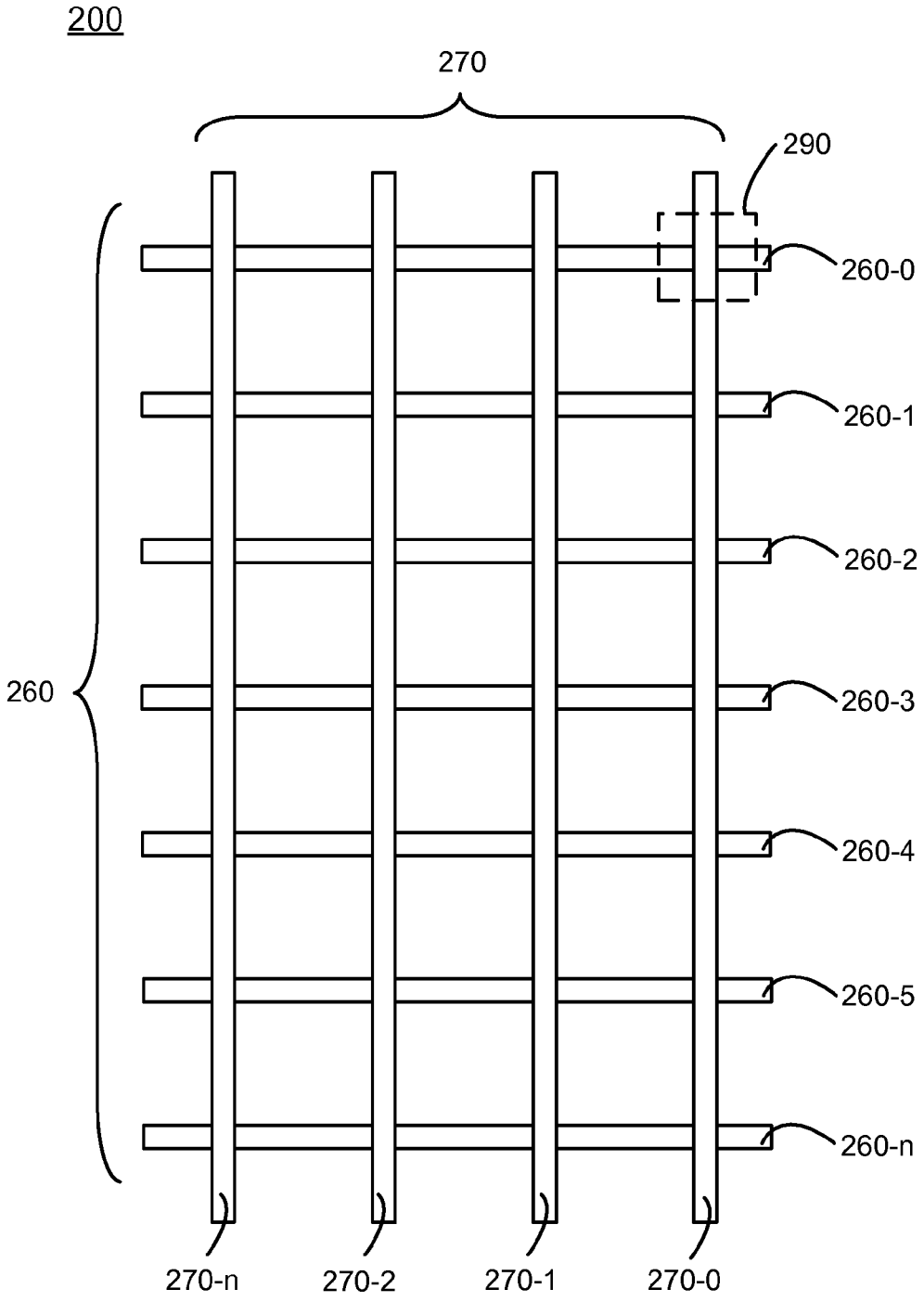
FIG. 2 shows a portion of an example sensor electrode pattern which may be utilized in a sensor to generate all or part of the sensing region of an input device, such as a touch screen, according to some embodiments.

FIG. 2 shows a portion of an example sensor electrode pattern 200 which may be utilized in a sensor to generate all or part of the sensing region of input device 100, according to various embodiments. Input device 100 is configured as a capacitive sensing input device when utilized with a capacitive sensor electrode pattern. For purposes of clarity of illustration and description, a non-limiting simple rectangular sensor electrode pattern 200 is illustrated. It is appreciated that numerous other sensor electrode patterns may be employed with the techniques described herein, including but not limited to: patterns with a single sensor electrode; patterns with a single set of sensor electrodes; patterns with two sets of sensor electrodes disposed in a single layer (without overlapping); patterns with two sets of sensor electrodes disposed in a single layer employing jumpers at crossover regions between sensor electrodes; patterns that utilize one or more display electrodes of a display device such as one or more segments of a common voltage ($V_{COM}$) electrode; patterns with one or more of source electrodes, gate electrodes, anode electrodes, and cathode electrodes; and patterns that provide individual button electrodes.

The illustrated sensor electrode pattern is made up of a first plurality of sensor electrodes 270 (270-0, 270-1, 270-2 . . . **270-*n*) and a second plurality of sensor electrodes 260 (260-0, 260-1, 260-2 . . . 260-*n*) which overlay one another, in this example. In many embodiments, processing system 110 is configured to operate the second plurality of sensor electrodes 260 as transmitter electrodes by driving them with transmitter signals and the first plurality of sensor electrodes 270 as receiver electrodes by receiving resulting signals with them. Other embodiments, may reverse the roles of sensor electrodes 260 and 270. In the illustrated example, sensing pixels are centered at locations where transmitter and receiver electrodes cross. Capacitive pixel 290 illustrates one of the capacitive pixels generated by sensor electrode pattern 200 during transcapacitive sensing. It is appreciated that in a crossing sensor electrode pattern, such as the illustrated example, some form of insulating material or substrate is typically disposed between transmitter electrodes 260 and receiver electrodes 270. However, in some embodiments, transmitter electrodes 260 and receiver electrodes 270 may be disposed on the same layer as one another through use of routing techniques and/or jumpers. In various embodiments, touch sensing includes sensing input objects anywhere in sensing region 120 and may comprise: no contact with any surfaces of the input device 100, contact with an input surface (e.g., a touch surface) of the input device 100, contact with an input surface of the input device 100** coupled with some amount of applied force or pressure, and/or a combination thereof.

When accomplishing transcapacitive measurements, capacitive pixels, such as capacitive pixel 290, are areas of localized capacitive coupling between transmitter electrodes 260 and receiver electrodes 270. The capacitive coupling between transmitter electrodes 260 and receiver electrodes 270 changes with the proximity and motion of input objects in the sensing region associated with transmitter electrodes 260 and receiver electrodes 270.

In some embodiments, sensor electrode pattern 200 is "scanned" to determine these capacitive couplings. That is, the transmitter electrodes 260 are driven to transmit transmitter signals. Transmitters may be operated such that one transmitter electrode transmits at one time, or multiple transmitter electrodes transmit at the same time. Where multiple transmitter electrodes transmit simultaneously, these multiple transmitter electrodes may transmit the same transmitter signal and produce an effectively larger transmitter electrode, or these multiple transmitter electrodes may transmit different transmitter signals. For example, multiple transmitter electrodes may transmit different transmitter signals according to one or more coding schemes that enable their combined effects on the resulting signals of receiver electrodes 270 to be independently determined.

The receiver electrodes 270 may be operated singly or multiply to acquire resulting signals. The resulting signals may be used to determine measurements of the capacitive couplings at the capacitive pixels where transmitter electrodes 260 and receiver electrodes 270 cross or interact to measure a transcapacitance.

A set of measurements from the capacitive pixels form a "capacitive image" (also "capacitive frame") representative of the capacitive couplings at the pixels. Multiple capacitive images may be acquired over multiple time periods, and differences between them used to derive information about input in the sensing region. For example, successive capacitive images acquired over successive periods of time can be used to track the motion(s) of one or more input objects entering, exiting, and within the sensing region.

In some embodiments, one or more sensor electrodes 260 or 270 may be operated to perform absolute capacitive sensing at a particular instance of time. For example, sensor electrode 270-0 may be charged and then the capacitance of sensor electrode 270-0 may be measured. In such an embodiment, an input object 140 interacting with sensor electrode 270-0 alters the electric field near sensor electrode 270-0, thus changing the measured capacitive coupling. In this same manner, a plurality of sensor electrodes 270 may be used to measure absolute capacitance and/or a plurality of sensor electrodes 260 may be used to measure absolute capacitance. It should be appreciated that when performing absolute capacitance measurements the labels of "receiver electrode" and "transmitter electrode" lose the significance that they have in transcapacitive measurement techniques, and instead a sensor electrode 260 or 270 may simply be referred to as a "sensor electrode" or may continue to use its designation as a transmitter electrode or a receiver electrode even though they are used in the same manner during absolute capacitive sensing.

Background capacitance, $C_B$, is the capacitive image of a sensor pattern or the absolute capacitance measured on a sensor electrode with no input object in the sensing region of a sensor electrode pattern. The background capacitance changes with the environment and operating conditions.

Capacitive images and absolute capacitance measurements can be adjusted for the background capacitance of the sensor device for more efficient processing. For example, various techniques may be employed internal and/or external to an ASIC/processing system to subtract/offset some amount of the baseline capacitance that is known to be present in an absolute capacitive measurement. In absolute capacitive sensing, such charge offsetting improves the dynamic range of an amplifier of the ASIC/processing system that is used to amplify a signal which includes an input object related component on top of the baseline absolute capacitance signal measurement. This is because the component of the signal attributed to presence of an input object can be more greatly amplified (without amplifier saturation) if some of the baseline portion is removed by internal offsetting.

Many techniques for internal offset (internal to the ASIC/processing system) of a baseline charge are known in the art and include utilizing an offsetting capacitance in parallel with a feedback capacitor of the amplifier and/or injecting charge to an input of the amplifier that is also coupled with the sensor from which an absolute capacitance is being measured.

In some embodiments, using techniques herein, one or more portions of a printed circuit (e.g., a flexible printed circuit, a printed circuit board, a lithographically printed circuit, or other type of printed circuit) that includes routing traces used to couple sensing signals to and/or from sensors in a sensing region of a sensing device can be used to offset some amount of the baseline capacitance measured during absolute capacitive sensing. This type of charge offsetting is accomplished external to the ASIC/processing system. It should be appreciated that any of the external charge offsetting techniques described herein may be utilized alone or may be used in combination with one or more internal charge offsetting techniques.

Example Processing System

Figure 3A:
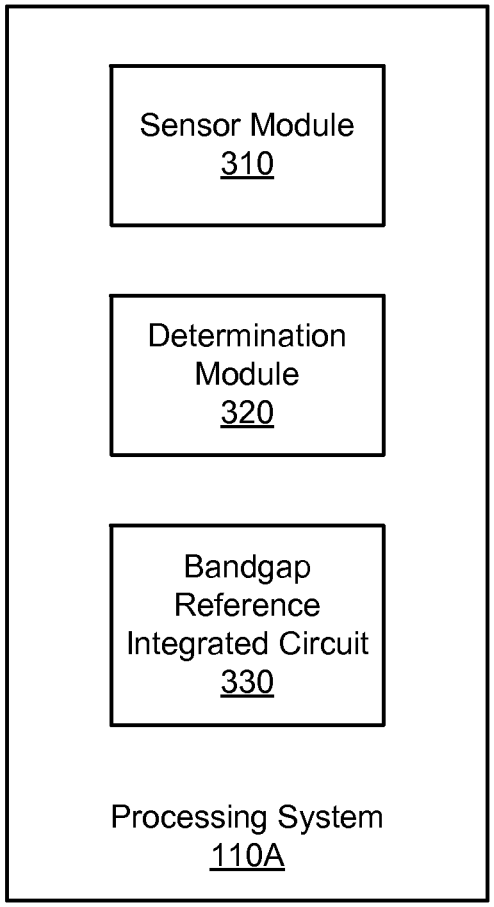
FIG. 3A illustrates a block diagram of some components of an example processing system, that may be utilized with an input device, according to various embodiments.

FIG. 3A illustrates a block diagram of some components of an example processing system 110A that may be utilized with an input device (e.g., in place of processing system 110 as part of input device 100), according to various embodiments. As described herein, input device 110 is a capacitive sensing input device. Processing system 110A may be implemented with one or more Application Specific Integrated Circuits (ASICSs), one or more Integrated Circuits (ICs), one or more controllers, or some combination thereof. In one embodiment, processing system 110A is communicatively coupled with one or more transmitter electrode(s) and receiver electrode(s) that implement a sensing region 120 of an input device 100. In some embodiments, processing system 110A and the input device 100 of which it is a part may be disposed in or communicatively coupled with an electronic system 150, such as a display device, computer, or other electronic system.

As depicted in FIG. 3A, in one embodiment, processing system 110A includes, among other components: sensor module 310, determination module 320, and a current-mode bandgap reference integrated circuit 330.

Processing system 110A and/or components thereof may be coupled with sensor electrodes of a sensor electrode pattern, such as sensor electrode pattern 200, among others. For example, sensor module 310 is coupled with one or more sensor electrodes (260, 270) of a sensor electrode pattern (e.g., sensor electrode pattern 200) of input device 100.

In various embodiments, sensor module 310 comprises sensor circuitry and operates to interact with the sensor electrodes, of a sensor electrode pattern, that are utilized to generate a sensing region 120. This includes operating a first plurality of sensor electrodes (e.g., sensor electrodes 260) to be silent, to be driven with a transmitter signal, to be used for transcapacitive sensing, and/or to be used for absolute capacitive sensing. This also includes operating a second plurality of sensor electrodes (e.g., sensor electrodes 270) to be silent, to be driven with a transmitter signal, to be used for transcapacitive sensing, and/or to be used for absolute capacitive sensing.

Sensor module 310 is configured to acquire transcapacitive resulting signals by transmitting with a first one of a plurality of sensor electrodes of the input device and receiving with a second one of the plurality of sensor electrodes. During transcapacitive sensing, sensor module 310 operates to drive (i.e., transmit) transmitter signals on one or more sensor electrodes of a first plurality of sensor electrodes (e.g., one or more of transmitter electrodes 260). A transmitter signal may be a square wave, trapezoidal wave, or some other waveform. In a given time interval, sensor module 310 may drive or not drive a transmitter signal (waveform) on one or more of the plurality of sensor electrodes. Sensor module 310 may also be utilized to couple one or more of the first plurality of sensor electrodes to high impedance, ground, or to a constant voltage when not driving a transmitter signal on such sensor electrodes. In some embodiments, when performing transcapacitive sensing, sensor module 310 drives two or more transmitter electrodes of a sensor electrode pattern at one time. When driving two or more sensor electrodes of a sensor electrode pattern at once, the transmitter signals may be coded according to a code. The code may be altered, such as lengthening or shortening the code. Sensor module 310 also operates to receive resulting signals, via a second plurality of sensor electrodes (e.g., one or more of receiver electrodes 270) during transcapacitive sensing. During transcapacitive sensing, received resulting signals correspond to and include effects corresponding to the transmitter signal(s) transmitted via the first plurality of sensor electrodes. These transmitted transmitter signals may be altered or changed in the resulting signal due to presence of an input object, stray capacitance, noise, interference, and/or circuit imperfections among other factors, and thus may differ slightly or greatly from their transmitted versions. It is appreciated that sensor module 310 may, in a similar fashion, transmit transmitter signals on one or more of sensor electrodes 270 and receive corresponding resulting signals on one or more of sensor electrodes 260.

In absolute capacitive sensing, a sensor electrode is both driven and used to receive a resulting signal that results from the signal driven on to the sensor electrode. In this manner, during absolute capacitive sensing, sensor module 310 operates to drive (i.e., transmit) a signal on to and receive a signal from one or more of sensor electrodes 260 or 270. During absolute capacitive sensing, the driven signal may be referred to as an absolute capacitive sensing signal, transmitter signal, or modulated signal, and it is driven through a routing trace that provides a communicative coupling between processing system 110A and the sensor electrode(s) with which absolute capacitive sensing is being conducted.

In various embodiments, sensor module 310 includes one or more amplifiers. Such an amplifier may be interchangeably referred to as an "amplifier," a "front-end amplifier," a "receiver," an "integrating amplifier," a "differential amplifier," or the like, and operates to receive a resulting signal at an input and provide an integrated voltage as an output. The resulting signal is from one or more sensor electrodes of a sensor electrode pattern, such as sensor electrode pattern 200. A single amplifier may be coupled with and used to receive a resulting signal from exclusively from a single sensor electrode, may receive signals from multiple sensor electrodes that are simultaneously coupled with the amplifier, or may receive signals from a plurality of sensor electrodes that are coupled one at a time to the amplifier. A sensor module 310 may include multiple amplifiers utilized in any of these manners. For example, in some embodiments, a first amplifier may be coupled with a first sensor electrode while a second amplifier is coupled with a second sensor electrode.

Determination module 320 may be implemented as hardware (e.g., hardware logic and/or other circuitry) and/or as a combination of hardware and instructions stored in a non-transitory manner in a computer readable storage medium.

Determination module 320 operates to compute/determine a measurement of a change in a transcapacitive coupling between a first and second sensor electrode during transcapacitive sensing. Determination module 320 then uses such measurements to determine the positional information comprising the position of an input object (if any) with respect to sensing region 120. The positional information can be determined from a transcapacitive image. The transcapacitive image is determined by determination module 320 based upon resulting signals acquired by sensor module 310. The resulting signals are used as or form capacitive pixels representative of input(s) relative to sensing region 120. It is appreciated that determination module 320 operates to decode and reassemble coded resulting signals to construct a transcapacitive image from a transcapacitive scan of a plurality of sensor electrodes.

In embodiments where absolute capacitive sensing is performed with sensor electrodes 260 and/or 270, determination module 320 also operates to compute/determine a measurement of absolute capacitive coupling to a sensor electrode. For example, determination module 320 operates to determine an absolute capacitance of the sensor electrode (e.g., sensor electrode 270-0) after a sensing signal has been driven on the sensor electrode. It should be noted that processing system 110A may, in some embodiments, compute an absolute capacitive image by combining (e.g., through multiplication, addition, or other means) absolute capacitive profiles measured along at least two different axes of a sensing region. With reference to FIG. 2 as an example, in some embodiments, determination module 320 creates an absolute capacitive image by combining a first absolute capacitive profile acquired with sensor electrodes 260 with a second absolute capacitive profile acquired with sensor electrodes 270. Determination module 320 then uses such measurements to determine the positional information comprising the position of an input object (if any) with respect to sensing region 120. The positional information can be determined from, for example, an absolute capacitive image or from absolute capacitive profiles.

In some embodiments determination module 320 may utilize measurements (i.e., resulting signals) obtained from both absolute capacitive sensing and transcapacitive sensing (instead of using measurements from just one type of these types capacitive sensing) in determining a position of an input object relative to sensing region 120. This is sometimes referred to as hybrid capacitive sensing. Determination module 320 then uses such measurements to determine the positional information comprising the position of an input object (if any) with respect to sensing region 120. The positional information can be determined from a hybrid capacitive image.

In some embodiments, processing system 110A comprises decision making logic which directs one or more portions of processing system 110A, such as sensor module 310 and/or determination module 320, to operate in a selected one of a plurality of different operating modes based on various inputs.

In FIG. 3A, current-mode bandgap reference integrated circuit 330 operates to provide one or more of a bandgap voltage, a zero-temperature current, and a proportional to absolute temperature current for use by processing system 100A and or by one or more other portions of input device 100. The supplied bandgap voltage is flat with respect to temperature.

Figure 3B:
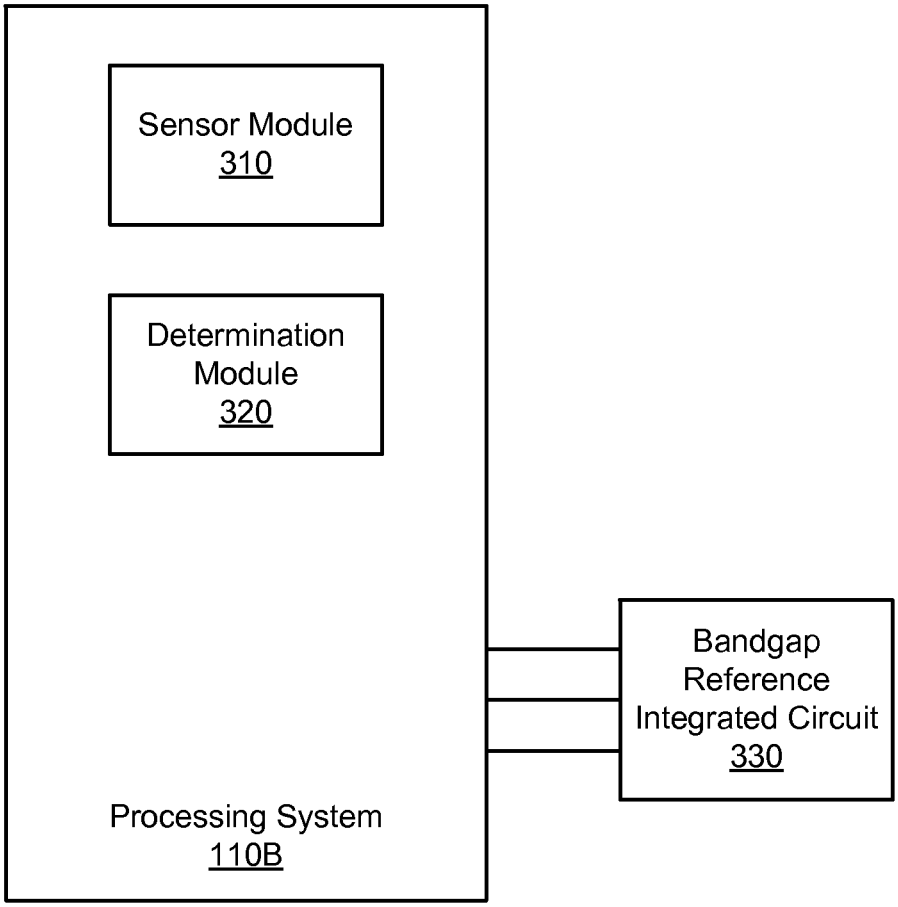
FIG. 3B illustrates a block diagram of some components of an example processing system that may be used with an input device, where the processing system is electrically coupled with a current-mode bandgap reference integrated circuit, according to various embodiments.

FIG. 3B illustrates a block diagram of some components of an example processing system 100B that may be used with an input device (e.g., in place of processing system 110 as part of input device 100), where the processing system is electrically coupled with a current-mode bandgap reference integrated circuit, according to various embodiments. As depicted in FIG. 3B, in one embodiment, processing system 110B includes, among other components: sensor module 310 and determination module 320. Processing system 100B is electrically coupled to an external current-mode bandgap reference integrated circuit 330. Via the electrical couplings, current-mode bandgap reference integrated circuit 330 operates to provide one or more of a bandgap voltage, a zero-temperature current, and a proportional to absolute temperature current for use by processing system 100B and or by one or more other portions of input device 100. It should be appreciated that the supplied bandgap voltage is flat with respect to temperature.

Example Current-Mode Bandgap Reference Integrated Circuits

Figure 4:
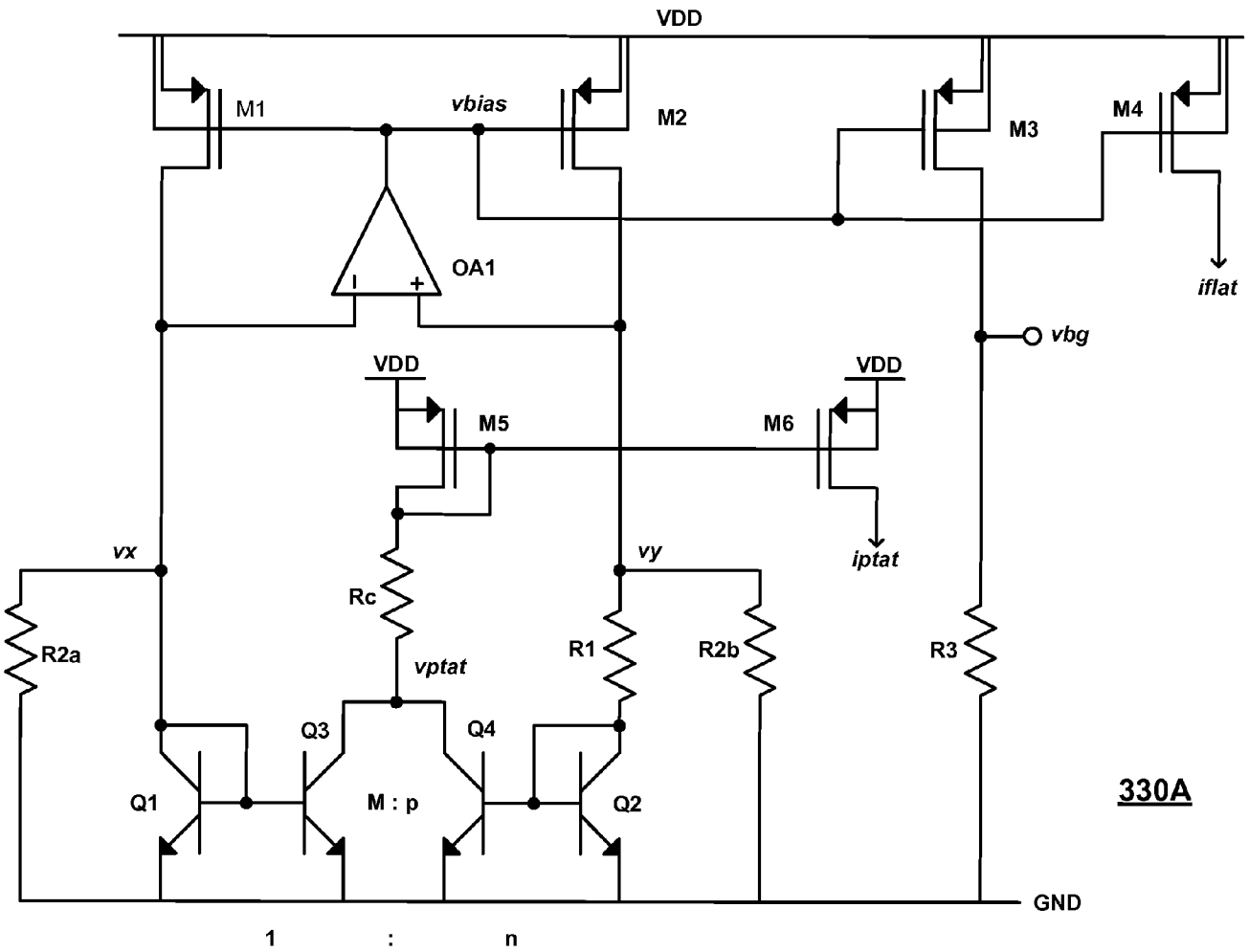
FIG. 4 illustrates a diagram of current-mode bandgap reference integrated circuit, according to some embodiments.
Figure 5:
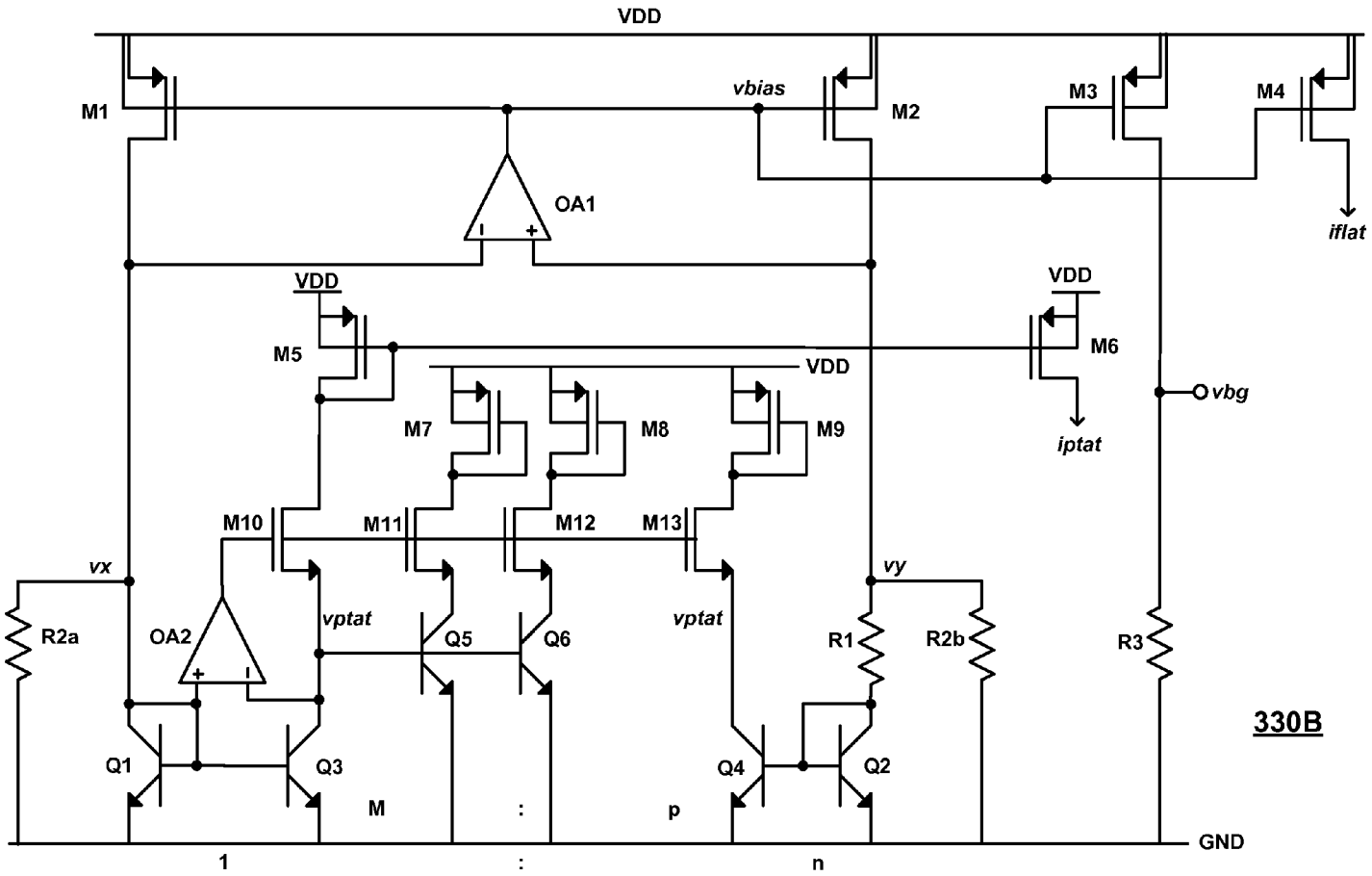
FIG. 5 illustrates a diagram of current-mode bandgap reference integrated circuit, according to some embodiments.
Figure 6:
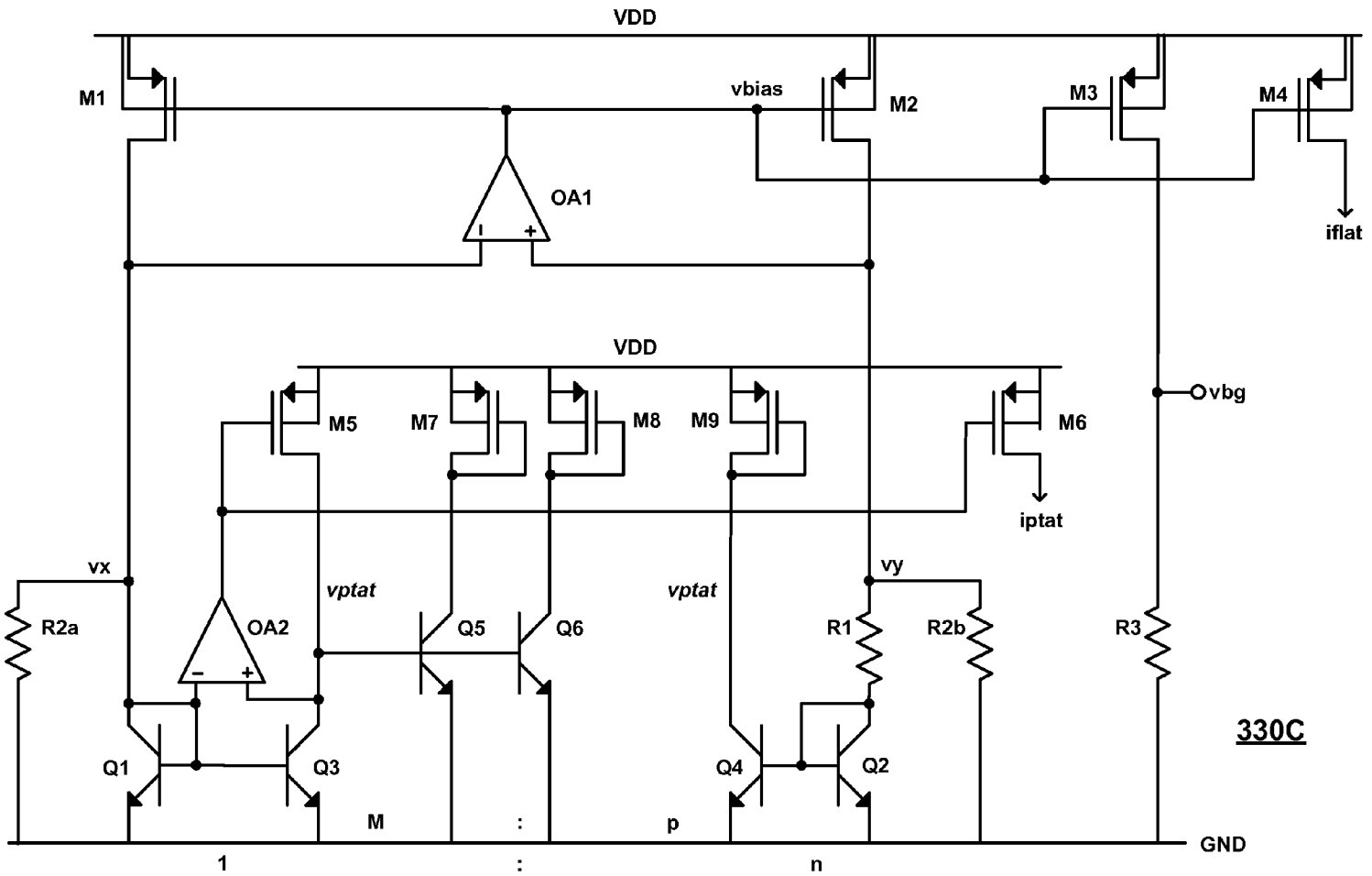
FIG. 6 illustrates a diagram of current-mode bandgap reference integrated circuit, according to some embodiments.

FIGS. 4, 5, and 6 illustrate three diagrams of current-mode bandgap reference integrated circuits (330A, 330B, 330C), according to various embodiments. The bandgap reference integrated circuits (330A, 330B, 330C) described herein, as well as the principles described by the circuits, may be used in a wide variety of applications of electronic devices, including being used in processing systems 110, electrically coupled to processing systems 110, and utilized within input devices 100. Further, bandgap reference integrated circuits utilizing the principles of FIGS. 4, 5 and 6 may be used in situations that have little or no relation to a proximity sensor device. Typically, a bandgap reference circuit produces a fixed voltage irrespective of power supply variations, temperature changes, and loading on a device. FIGS. 4, 5, and 6 illustrate low-voltage, current-mode bandgap reference architectures that produce a PTAT (proportional to absolute temperature) current and a ZTC (zero temperature coefficient) in addition to the bandgap voltage. While FIGS. 4, 5 and 6 illustrate specific circuit implementations of current-mode bandgap reference integrated circuits, the principles described by one or more of the figures can be applied to a wide variety of bandgap reference integrated circuits.

It should be noted that there are numerous commonalities to the components, design, and architecture of the circuits, especially the use and selection of bipolar junction transistors (BJTs), Q1, Q2, Q3, and Q4 and the presence of error amplifier OA1. The selection, sizing, and ratios of these BJTs are common to all of circuits 4, 5, and 6. FIG. 4 provides an example of the basic circuit 330A. FIG. 5 shows a variation on this basic circuit in which several components are added to provide greater accuracy through cancellation of the effects of Beta limitations of Q1, Q2, Q3, and Q4, along with several components (M10, M11, M12, and M13) added to ease design constraints by ensuring stability of the added error amplifier OA2. FIG. 6 shows the circuit of FIG. 5, in which these stabilizing components (M10, M11, M12, and M13) have been eliminated; resulting in a circuit which can operate in the 1V or less realm (i.e., >0V and ≤1V). It should be appreciated that any of the circuits of FIG. 4, FIG. 5, and FIG. 6 may be implemented in any CMOS process. The circuit of FIG. 4 generally requires BJTs with Betas above 20, but the circuits of FIGS. 5 and 6 have no such limitation on Beta.

With reference now to FIG. 4, current-mode bandgap reference integrated circuit 330A comprises: four BJT transistors (Q1, Q2, Q3, and Q4); six p-channel metal oxide semiconductor (PMOS) field effect transistor devices (M1, M2, M3, M4, M5, and M6); one operational amplifier, error amplifier OA1; and five resistors (Rc, R1, R2*a*, R2*b*, and R3). Devices M1, M2, M3, M4, M5, and M6 are referred to herein as "PMOS devices."

As depicted, the body and source of each of M1, M2, M3, M4 are coupled with VDD, which may be, in some embodiments 1.8V. In other embodiments VDD may be 1V. The gate of M1 is coupled with the output of OA1, the gate of M2, the gate of M3, and gate of M4. The drain of M1 is coupled with the inverting input of error amplifier OA1, the collector of Q1, the base of Q1, the base of Q3, and a first side of resistor R2*a*. The drain of M2 is coupled with the non-inverting input of error amplifier OA1, to a first side of resistor R1, and to a first side of resistor R2*b*. The drain of M3 is coupled with a first side of resistor R3 and also provides an output of the reference bandgap voltage, vbg. The drain of M4 provides a ZTC current, iflat, as an output. The second side of each of resistors R2*a*, R2*b*, and R3 is coupled to ground. The body and source are tied on M5 as well as on M6, and each tied body and source is coupled with VDD. The gate and drain of M5 are coupled with the first side of resistor Rc and with the gate of M6. The drain of M6 provides a current proportional to absolute temperature, iptat, as an output. The second side of resistor R1 is coupled with the collector of Q2 and the bases of Q2 and Q4, while the second side of resistor Rc is coupled with the collectors of Q3 and Q4. The base of Q1 is coupled with the base of Q3; and Q1 and Q3 constitute a first pair of BJT transistors. The base of Q2 is coupled with the base of Q4; and Q2 and Q4 constitute a second pair of BJT transistors. The collectors of Q3 and Q4 are tied with one another and to the second side of resistor Rc. The emitters of Q1, Q2, Q3, and Q4 are coupled to ground. A voltage proportional to absolute temperature, vptat, is output from the tied collectors of Q3 and Q4. This also inherently provides a PTAT current through resistor Rc.

Q1 and Q2 provide the VBE voltages needed to create the ZTC current and the bandgap voltage. Q1 has a VBE voltage across its terminals that is set at Vx and Vy by error amplifier OA1. Q2 is intentionally larger than Q1 to decrease its VBE voltage, so the difference between Vy and the collector of Q2 is the difference in VBE of Q1 and Q2. Delta VBE into R1 is a PTAT current, and VBE into R2B is a CTAT current. These two currents are summed at the nodes vx and vy to produce the ZTC current. Transistors Q3 and Q4 are mirrors of Q1 and Q2 respectively. Because transistor M3 is sourcing the ZTC current, placing this current across resistor R3 will give a flat voltage, which is bandgap voltage, vbg. It should be noted that the bandgap voltage can be adjusted to a desired value by selecting the size of resistor R3.

Transistors M1 and M2 act as current sources which work to supply a constant current to the legs that they are respectively attached to (Q1 leg and the Q2 leg which are respectively mirrored out onto Q3 and Q4). Transistors M3 and M4 also act as current sources with a current equal to the ZTC current. OA1 is an error amplifier working to equalize the node voltages Vx and Vy on the inverting and non-inverting inputs to be equal to a VBE voltage of Q1. M5 is a diode (gate and drain coupled), and mirrors out the PTAT current to transistor M6 which outputs the current, iptat, on its drain. It should be appreciated that the ratio of the size of Q1:Q3 is the same as the ratio of the size of Q2:Q4; this is represented as M:p in FIG. 4. The symbols M and p will be further described in the equations below. It is further appreciated that the relationship between the sizes of transistors Q1 and Q2 is a 1:n relationship and that the ratio of the sizes of transistors Q3 and Q4 follows the same 1:n relationship.

The operation of the circuit in FIG. 4 relies on a CMOS (complementary metal oxide semiconductor) process that has relatively good BJT (bipolar junction transistor) Betas in the 20-40 range. Given that the current through Q1 and Q2 is a PTAT current given by the expression in Eq. 1, it stands to reason that using a second BJT to mirror this current would allow for a PTAT current reference to easily be added to this circuit. However, due to the value of the transistor Betas, there is a source of error caused by the base current in each BJT. Adding additional BJTs, as proposed here, would draw more base current from each current branch which minimizes the BJT current density. In all equations, Beta is process driven and is the same due to the same process being used to fabricate all of the BJT transistors involved in the integrated circuit.

$$I_{Q1} = I_{Q2} = \frac{\Delta V_{BE}}{R_1} = \frac{\frac{kT}{q}\eta \ln(n)}{R_1} \qquad \text{Equation 1}$$

In Eq. 1, k is Boltzmann's constant ($1.38\times10^{-23}$ J/K); q is electronic charge ($1.6\times10^{19}$ C), one elementary unit of charge; η is process driven and is usually approximately 1;

and n in the natural log expression is the ratio of the emitter area of Q2:Q1. In some designs the ratio of the emitter areas of Q2:Q1 may be designed at a value of 8, but can this ratio can have other values. Also, kT/q is commonly referred to as the thermal voltage $\phi_t$.

For simplicity, kT/q will be denoted as $\phi_t$ in the following equations. The current through the resistor R1 is given in Eq. 2. The current in the branch that Q1 is connected to is given in Eq. 3. Because the error amplifier, OA1, is controlling the PMOS current sources, Ix=IR1 and a new expression for $\Delta V_{BE}$ is given in Eq. 4.

$$I_{R1} = I_{C2} + I_{B2} + I_{B4} - J_S A_E e^{(V_{BE,2}/\varphi_t)}\left[\frac{n(\beta+1)+p}{\beta}\right] \quad \text{Equation 2}$$

$$I_x = I_{C1} + I_{B1} + I_{B3} = J_S A_E e^{(V_{BE,1}/\varphi_t)}\left[\frac{(\beta+1)+M}{\beta}\right] \quad \text{Equation 3}$$

$$\Delta V_{BE} = \eta\varphi_t \ln\left[\frac{n(\beta+1)+p}{\beta+1+M}\right] \quad \text{Equation 4}$$

In Eq. 2, $J_s$ is the current density of the BJT; $A_E$ is Eq. 2 is the emitter area of Q4 and $A_E$ is Eq. 3 is the emitter area of Q3. In Eq. 3, M is the ratio of the emitter areas of Q3:Q1.

Ideally, Eq. 4 should exhibit no dependency on β, otherwise there will be a process and temperature sensitive parameter where there was not one previously. To achieve this cancellation, the ratio of p/n must equal M. For the smallest area, this occurs at M=1 and p=n such that $\Delta VBE=\eta\phi_t \ln(n)$. This shows that the PTAT circuitry will have no impact on the bandgap core, however there will be mismatch in the PTAT current driven by Eq. 5.

$$I_{PTAT} = \frac{\eta\varphi_t \ln(n)}{R_1\left(1+\frac{2}{\beta}\right)} \quad \text{Equation 5}$$

As long as β is large, such as above 50, this mismatch does not matter. However, for typical BJTs in CMOS processes, this dependency on β will add additional temperature and process variation to the PTAT current. If β does not have a significant temperature coefficient, this effect is of no concern (outside of an absolute current mismatch). When β is not large, additional components may be added to the basic current-mode bandgap reference integrated circuit 330A of FIG. 4 in order to cancel out non-linearity errors caused by β limitations of the BJT transistors that would otherwise be present in PTAT current and voltage. Integrated circuit 330B of FIG. 5 and integrated circuit 330C of FIG. 6 illustrate embodiments which components have been added to implement β cancellation, and therefore provide for further use in processes that do not provide for fabrication of BJTs with high β values (i.e., above 50).

With reference now to FIG. 5, current-mode bandgap reference integrated circuit 330B comprises: six BJT transistors (Q1, Q2, Q3, Q4, Q5, and Q6); nine p-channel metal oxide semiconductor (PMOS) field effect transistor devices (M1, M2, M3, M4, M5, M6, M7, M8, and M9); 4 n-channel metal oxide semiconductor (NMOS) field effect transistor devices (M10, M11, M12, and M13); two operational amplifiers (error amplifier OA1 and error amplifier OA2); and four resistors (R1, R2*a*, R2*b*, and R3). Devices M1, M2, M3, M4, M5, M6, M7, M8, and M9 are referred to herein as "PMOS devices." In some embodiments, M1, M2, M3, M4, M5, and M6 are medium voltage devices. Devices M10, M11, M12, and M13 are referred to herein as "NMOS devices." In some embodiments M10, M11, M12, and M13 are low voltage devices which are capable of operating at or below 1V.

As depicted, the body and source of each of M1, M2, M3, and M4 are coupled with VDD, which may be, in some embodiments 1.8V. In other embodiments VDD may be 1V. The gate of M1 is coupled with the output of OA1, the gate of M2, the gate of M3, and gate of M4. The drain of M1 is coupled with the inverting input of error amplifier OA1, the collector of Q1, the base of Q1, the base of Q3, the non-inverting input of error amplifier OA2, and a first side of resistor R2*a*. The drain of M2 is coupled with the non-inverting input of error amplifier OA1, to a first side of resistor R1, and to a first side of resistor R2*b*. The drain of M3 is coupled with a first side of resistor R3 and also provides an output of the reference bandgap voltage, vbg. The drain of M4 provides a ZTC current, iflat, as an output. The second side of each of resistors R2*a*, R2*b*, and R3 is coupled to ground. The body and source are tied on M5, as well as on M6, M7, M8, and M9 and each tied body and source is coupled with VDD. The body and source are tied on each of NMOS devices M10, M11, M12, and M13. The gate and drain of M5 are coupled, in diode configuration, with the drain of M10 and with the gate of M6. The gate and drain of M7 are coupled, in diode configuration, with the drain of M11. The gate and drain of M8 are coupled, in diode configuration, with the drain of M12. The gate and drain of M9 are coupled, in diode configuration, with the drain of M13. The drain of M6 provides a current proportional to absolute temperature, iptat, as an output. The second side of resistor R1 is coupled the collector of Q2 and the bases of Q2 and Q4. The base of Q1 is coupled with the collector of Q1, the base of Q3, and the non-inverting input of error amplifier OA2; and Q1 and Q3 constitute a first pair of BJT transistors. The base of Q2 is coupled with the base of Q4; and Q2 and Q4 constitute a second pair of BJT transistors. The collector of Q3 is coupled to source of M10, the bases of Q5 and Q6, and the inverting input of error amplifier OA2. The output of OA2 is coupled to the gates of M10, M11, M12, and M13. The collector of Q5 is coupled to the source of M11, the collector of Q6 is coupled to the source of M12, and the collector of Q4 is coupled to the source of M13. The emitters of Q1, Q2, Q3, Q4, Q5, and Q6 are coupled to ground. A voltage proportional to absolute temperature, vptat, is output from the tied collectors of Q3 and Q4. This also inherently provides a PTAT current which is mirrored out through the drain of M6.

Q1 and Q2 provide the VBE voltages needed to create the ZTC current and the bandgap voltage. Q1 has a VBE voltage across its terminals that is set at Vx and Vy by error amplifier OA1. Q2 is intentionally larger than Q1 to decrease its VBE voltage, so the difference between Vy and the collector of Q2 is the difference in VBE of Q1 and Q2. Delta VBE into R1 is a PTAT current, and VBE into R2B is a CTAT current. These two currents are summed at the nodes vx and vy to produce the ZTC current. Transistors Q3 and Q4 are mirrors of Q1 and Q2 respectively. Because transistor M3 is sourcing the ZTC current, placing this current across resistor R3 will give a flat voltage, which is bandgap voltage, vbg. It should be noted that this bandgap voltage can be adjusted to a desired value by selecting the size of resistor R3.

Transistors M1 and M2 act as current sources which work to supply a constant current to the legs that they are respectively attached to (Q1 leg and the Q2 leg which are respectively mirrored out onto Q3 and Q4). Transistors M3 and M4 also act as current sources with a current equal to the ZTC current. OA1 is an error amplifier working to equalize the node voltages Vx and Vy on the inverting and non-inverting inputs to be equal to a VBE voltage of Q1. M5 is a diode (gate and drain coupled), and mirrors out the PTAT current to transistor M6 which outputs the current, iptat, on its drain. It should be appreciated that the ratio of the size of Q1:Q3 is the same as the ratio of the size of Q2:Q4; this is represented as M:p in FIG. 5. The symbols M and p were described above in Equations 2, 3, and 4. It is further appreciated that the relationship between the sizes of transistors Q1 and Q2 is a 1:n relationship and that the ratio of the sizes of transistors Q3 and Q4 follows the same 1:n relationship.

Error amplifier OA2 operates to ensure the collector voltage of Q1 and Q3 are the same by keeping the voltages on its inverting and non-inverting inputs equal. Error amplifier OA2 further operates to ensure the base voltages of Q5 and Q6 have to be equal to the base voltages of Q1 and Q3. Since Q1 has its collector and base shorted together, this means that the collector voltage of Q3 is also the same as the base and collector voltages of Q1.

Transistors M11, M12, and M13 relax the design requirements and ensure stability for error amplifier OA2 by ensuring the collector of Q3 has the same voltage as the collector of Q1. This also eases concerns about extra dominant poles in error amplifier OA2 that would possibly degrade the response of error amplifier OA2 and might cause ringing at the output of error amplifier OA2. M10, M11, M12, and M13 also force the collector voltages to be the same on transistors Q3, Q4, Q5, and Q6.

The circuit in FIG. 5 may be implemented with a CMOS (complementary metal oxide semiconductor) process. Equations 1-5 described above are also applicable to BJTs Q1, Q2, Q3, and Q4 of FIG. 5.

As previously described, FIG. 5 illustrates an additional embodiment of a current mode bandgap reference integrated circuit 330B, which generates a PTAT and ZTC current and is capable of being operating with a supply voltage, VDD, at or above 1V. To compensate for the mismatch in PTAT current driven by Eq. 5, integrated circuit 330B adds an error amplifier OA2 between the collector terminals of Q1 and Q3. Error amplifier OA2 drives an NMOS device, M10, whose source is connected to the collector of Q3 which forces the condition $V_{CE1}=V_{CE3}$. As long as this is true, and the base-emitter voltages are equal (which they are by design), the collector currents through Q1 and Q3 will be equal. With these collector currents equal, error amplifier OA2 can drive two more NMOS devices, M11 and M12, connected to two individual BJTs. These BJTs, Q5 and Q6, have their bases connected to the collector of Q3 which will add current seen by the diode-connected PMOS device, M5, attached to the drain of the NMOS device, M10, in the Q3 branch, as shown in Eq. 6. Since the collector currents of Q1, Q3, Q5, and Q6 are equal (due to the error amplifier OA2), the resultant expression for the output PTAT current is given in Eq. 7 which shows that the effects due to a finite 13 can be completely cancelled out and eliminated with a very small impact to area and power.

$$I_{PTAT} = I_{C3} + \frac{I_{C5}}{\beta} + \frac{I_{C6}}{\beta} = I_{C3}\left(1 + \frac{2}{\beta}\right) \quad \text{Equation 6}$$

-continued $$I_{PTAT} = \frac{\eta\varphi_t \ln(n)}{R_1\left(1 + \frac{2}{\beta}\right)} \cdot \left(1 + \frac{2}{\beta}\right) = \frac{\eta\varphi_t \ln(n)}{R_1} \quad \text{Equation 7}$$

With reference now to FIG. 6, current-mode bandgap reference integrated circuit 330C comprises: six BJT transistors (Q1, Q2, Q3, Q4, Q5, and Q6); nine p-channel metal oxide semiconductor (PMOS) field effect transistor devices (M1, M2, M3, M4, M5, M6, M7, M8, and M9); two operational amplifiers (error amplifier OA1 and error amplifier OA2); and four resistors (R1, R2*a*, R2*b*, and R3). Devices M1, M2, M3, M4, M5, M6, M7, M8, and M9 are referred to herein as "PMOS devices." In some embodiments, M1, M2, M3, M4, M5, and M6 are medium voltage devices. Integrated circuit 330C is similar to integrated circuit 330B, except for the elimination of the NMOS devices of integrated circuit 330B, the flipping of the inverting and non-inverting inputs of error amplifier OA2, and some reconfiguration of the connections to terminals of M5. These changes reduce the component count and layout area requirements for integrated circuit 330C versus integrated circuit 330B. The elimination of the NMOS devices found in integrated circuit 330B permit integrated circuit 330C to operate at lower supply voltages than integrated circuit 330B. In some embodiments, there are no practical limits to how low the supply voltage, VDD, can be in integrated circuit 330C, so long as it is greater than VCE of Q3 (which is also VBE of Q1 in the described circuits).

As depicted, the body and source of each of M1, M2, M3, and M4 are coupled with VDD, which may be, in some embodiments 1.8V. In other embodiments VDD may be 1V. In yet other embodiments, VDD may be between 0V and 1V, such as 0.7V. The gate of M1 is coupled with the output of OA1, the gate of M2, the gate of M3, and gate of M4. The drain of M1 is coupled with the inverting input of error amplifier OA1, the collector of Q1, the base of Q1, the base of Q3, the inverting input of error amplifier OA2, and a first side of resistor R2*a*. The drain of M2 is coupled with the non-inverting input of error amplifier OA1, to a first side of resistor R1, and to a first side of resistor R2*b*. The drain of M3 is coupled with a first side of resistor R3 and also provides an output of the reference bandgap voltage, vbg. The drain of M4 provides a ZTC current, iflat, as an output. The second side of each of resistors R2*a*, R2*b*, and R3 is coupled to ground. The body and source are tied on M5, as well as on M6, M7, M8, and M9 and each tied body and source is coupled with VDD. The gate of M5 is coupled with the output of error amplifier OA2 and the gate of M6. The gate and drain of M7 are coupled, in diode configuration, with the collector of Q5. The gate and drain of M8 are coupled, in diode configuration, with the collector of Q6. The gate and drain of M9 are coupled, in diode configuration, with the collector of Q4. The drain of M6 provides a current proportional to absolute temperature, iptat, as an output. The second side of resistor R1 is coupled with the collector of Q2 and the bases of Q2 and Q4. The base of Q1 is coupled with the collector of Q1, the base of Q3, and the inverting input of error amplifier OA2; and Q1 and Q3 constitute a first pair of BJT transistors. The base of Q2 is coupled with the base of Q4; and Q2 and Q4 constitute a second pair of BJT transistors. The collector of Q3 is coupled to drain of PMOS device M5, the bases of Q5 and Q6, and the non-inverting input of error amplifier OA2. The output of OA2 is coupled to the gates of M5 and M6. The emitters of Q1, Q2, Q3, Q4, Q5, and Q6 are coupled to ground. A voltage proportional to absolute temperature, vptat, is output from the tied collectors of Q3 and Q4. This also inherently provides a PTAT current which is mirrored out through the drain of M6.

Q1 and Q2 provide the VBE voltages needed to create the ZTC current and the bandgap voltage. Q1 has a VBE voltage across its terminals that is set at Vx and Vy by error amplifier OA1. Q2 is intentionally larger than Q1 to decrease its VBE voltage, so the difference between Vy and the collector of Q2 is the difference in VBE of Q1 and Q2. Delta VBE into R1 is a PTAT current, and VBE into R2B is a CTAT current. These two currents are summed at the nodes vx and vy to produce the ZTC current. Transistors Q3 and Q4 are mirrors of Q1 and Q2 respectively. Because transistor M3 is sourcing the ZTC current, placing this current across resistor R3 will give a flat voltage, which is bandgap voltage, vbg. It should be noted that, in FIG. 6, this can be a sub 1V bandgap voltage (i.e., >0V and <1V) that that this bandgap voltage can be adjusted to a desired value by selecting the size of resistor R3.

Transistors M1 and M2 act as current sources which work to supply a constant current to the legs that they are respectively attached to (Q1 leg and the Q2 leg which are respectively mirrored out onto Q3 and Q4). Transistors M3 and M4 also act as current sources with a current equal to the ZTC current. OA1 is an error amplifier working to equalize the node voltages Vx and Vy on the inverting and non-inverting inputs to be equal to a VBE voltage of Q1. It should be appreciated that the ratio of the size of Q1:Q3 is the same as the ratio of the size of Q2:Q4; this is represented as M:p in FIG. 5. The symbols M and p were described above in Equations 2, 3, and 4. It is further appreciated that the relationship between the sizes of transistors Q1 and Q2 is a 1:n relationship and that the ratio of the sizes of transistors Q3 and Q4 follows the same 1:n relationship.

Error amplifier OA2 operates to ensure the collector voltage of Q1 and Q3 are the same by keeping the voltages on its inverting and non-inverting inputs equal. Error amplifier OA2 further operates to ensure the base voltages of Q5 and Q6 have to be equal to the base voltages of Q1 and Q3. Since Q1 has its collector and base shorted together, this means that the collector voltage of Q3 is also the same as the base and collector voltages of Q1.

The circuit in FIG. 6 may be implemented with a CMOS (complementary metal oxide semiconductor) process. Equations 1-5 described above are also applicable to BJTs Q1, Q2, Q3, and Q4 of FIG. 6.

As previously described, FIG. 6 illustrates an additional embodiment of a current mode bandgap reference integrated circuit 330C, which generates a PTAT and ZTC current and is capable of being operating with a supply voltage, VDD, at or below 1V (i.e., VDDs above 0V and less than or equal to 1V). To compensate for the mismatch in PTAT current driven by Eq. 5, integrated circuit 330C adds an error amplifier OA2 between the collector terminals of Q1 and Q3. Error amplifier OA2 drives a PMOS device, M5, whose drain is connected to the collector of Q3 which forces the condition $V_{CE1}=V_{CE3}$. As long as this is true, and the base-emitter voltages are equal (which they are by design), the collector currents through Q1 and Q3 will be equal. BJTs, Q5 and Q6, have their bases connected to the collector of Q3 which will add current seen by the PMOS device, M5, attached to the output of the Q3 branch, as shown in Eq. 6. Since the collector currents of Q1, Q3, Q5, and Q6 are equal (due to the error amplifier OA2), the resultant expression for the output PTAT current is given in Eq. 7 which shows that the effects due to a finite β can be completely cancelled and eliminated with a very small impact to area and power. The circuit structure in FIG. 6 differs from the circuits illustrated in FIG. 4 and FIG. 5 primarily because it removes the diode-connected PMOS of M5. This decreases the minimum achievable supply voltage at the expense of a more complicated design required for OA2 (i.e., OA2 requires more power and area that would be required by OA2 in FIG. 5).

In integrated circuits 330A, 330B, and 330C, a bandgap voltage generator is formed of at least Q1, Q2, R1 and R3 and operates to generate bandgap voltage, vbg. In particular, the ZTC current into R3 produces the bandgap voltage, vbg.

In integrated circuits 330A, 330B, and 330C, a zero-temperature coefficient (ZTC) current generator is formed of at least Q1, Q2, R1, R2A, and R2B plus M4 and operates to generate the ZTC current, iflat.

In integrated circuits 330A, 330B, and 330C, a current proportional to absolute temperature (PTAT) current generator is formed of at least Q1, Q2, R1, R2A, R2B, plus Q3 and Q4 and operates to generate the PTAT current, iptat, which is mirrored out of M6.

In some embodiments, as illustrated in integrated circuits 330B and 330C, additional Beta cancellation circuitry comprising at least Q5 and Q6 cancel any Beta term in the PTAT current, iptat, that is mirrored out of M6. This Beta cancellation circuitry may further comprise one or more additional components such as one or more of M5, M7, M8, and M9, in some embodiments.

The examples set forth herein were presented in order to best explain, to describe particular applications, and to thereby enable those skilled in the art to make and use embodiments of the described examples. However, those skilled in the art will recognize that the foregoing description and examples have been presented for the purposes of illustration and example only. The description as set forth is not intended to be exhaustive or to limit the embodiments to the precise form disclosed.

Reference throughout this document to "one embodiment," "certain embodiments," "an embodiment," "various embodiments," "some embodiments," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

What is claimed is:

1. A current-mode bandgap reference integrated circuit comprising:

a bandgap voltage generator configured to generate a bandgap voltage;

a zero-temperature coefficient current generator configured to generate a zero-temperature coefficient current;

a proportional to absolute temperature current generator configured to generate a proportional to absolute temperature current;

a first pair of biopolar junction transistors (BJT) comprising a first BJT and a second BJT;

a second pair of bipolar junction transistors, comprising a third BJT and a fourth BJT, wherein said first pair of BJTs matches said second pair of BJTs; and a first error amplifier, wherein a first input of said first error amplifier is coupled with a collector of at least one BJT of said first BJT pair, wherein a second input of said first error amplifier is coupled through a first resistor to a collector of at least one BJT of said second BJT pair, and wherein an output of said first error amplifier is coupled to a gate of a first p-channel metal oxide semiconductor (PMOS) device and a gate of a second PMOS device.

2. The current-mode bandgap reference integrated circuit of claim 1, wherein a ratio of said first BJT pair matches a ratio of said second BJT pair.

3. The current-mode bandgap reference integrated circuit of claim 1, wherein a first side of said first resistor is coupled to a drain of said second PMOS device, and wherein a second side of said first resistor is coupled to the collector of said at least one BJT of said second BJT pair.

4. The current-mode bandgap reference integrated circuit of claim 3, further comprising: a plurality of components configured to provide Beta cancellation for said proportional to absolute temperature current.

5. The current-mode bandgap reference integrated circuit of claim 1, further comprising: a second error amplifier, wherein a first input of said second error amplifier is coupled to a collector of said first BJT, and wherein a second input of said second error amplifier is coupled to a collector of said second BJT.

6. The current-mode bandgap reference integrated circuit of claim 5, wherein said second error amplifier is configured to drive an n-channel metal oxide semiconductor (NMOS) device, and wherein a source of said NMOS device is coupled to said collector of said second BJT.

7. The current-mode bandgap reference integrated circuit of claim 5, wherein said second error amplifier is configured to drive a third PMOS device, and wherein a drain of said third PMOS device is coupled to said collector of said second BJT.

8. The current-mode bandgap reference integrated circuit of claim 5, further comprising:

a fifth BJT and a sixth BJT, wherein bases of said fifth BJT and said sixth BJT are each coupled to said collector of said second BJT.

9. The current-mode bandgap reference integrated circuit of claim 8, further comprising: four identical n-channel metal oxide semiconductor (NMOS) devices configured as source followers which provide matching voltages at their respective sources, wherein a source of a first of said four NMOS devices is coupled to said collector of said second BJT, a source of a second of said four NMOS devices is coupled to a collector of said fourth BJT, a source of a third of said four NMOS devices is coupled to a collector of said fifth BJT, and a source of a fourth of said four NMOS devices is coupled to a collector of said sixth BJT.

10. An input device, said input device comprising:

a plurality of sensor electrodes disposed in a sensor electrode pattern; and a processing system coupled with said plurality of sensor electrodes, said processing system configured to:

sense capacitive inputs from said sensor electrodes; and determine a position of an input object relative to said sensor electrode pattern based on said sensed capacitive inputs; and a current-mode bandgap reference integrated circuit coupled with said processing system, said integrated circuit comprising:

a bandgap voltage generator configured to generate a bandgap voltage;

a zero-temperature coefficient current generator configured to generate a zero-temperature coefficient current;

a proportional to absolute temperature current generator configured to generate a proportional to absolute temperature current;

a first pair of bipolar junction transistors (BJT) comprising a first BJT and a second BJT;

a second pair of bipolar junction transistors, comprising a third BJT and a fourth BJT, wherein said first pair of BJTs matches said second pair of BJTs, wherein said integrated circuit provides one or more of said bandgap voltage, said zero-temperature current, and said proportional to absolute temperature current for use by said processing system; and a first error amplifier, wherein a first input of said first error amplifier is coupled with a collector of at least one BJT of said first BJT pair, wherein a second input of said first error amplifier is coupled through a first resistor to a collector of at least one BJT of said second BJT pair, and wherein an output of said first error amplifier is coupled to a gate of a first p-channel metal oxide semiconductor (PMOS) device and a gate of a second PMOS device.

11. The input device of claim 10, wherein a ratio of said first BJT pair matches a ratio of said second BJT pair.

12. The input device of claim 10, wherein a first side of said first resistor is coupled to a drain of said second PMOS device, and wherein a second side of said first resistor is coupled to the collector of said at least one BJT of said second BJT pair.

13. The input device of claim 12, wherein within said integrated circuit: a first plurality of components are configured to provide Beta cancellation for said first resistor; and a second plurality of components are configured to provide Beta cancellation for said proportional to absolute temperature current.

14. The input device of claim 10, said integrated circuit further comprises: a second error amplifier, wherein a first input of said second error amplifier is coupled to a collector of said first BJT, and wherein a second input of said second error amplifier is coupled to a collector of said second BJT.

15. The current-mode bandgap reference integrated circuit of claim 14, wherein said second error amplifier is configured to drive an n-channel metal oxide semiconductor (NMOS) device, and wherein a source of said NMOS device is coupled to said collector of said second BJT.

16. The input device of claim 14, wherein said second error amplifier is configured to drive a third PMOS device, and wherein a drain of said third PMOS device is coupled to said collector of said second BJT.

17. The input device of claim 14, wherein said integrated circuit further comprises: a fifth BJT and a sixth BJT, wherein bases of said fifth BJT and said sixth BJT are each coupled to said collector of said second BJT.

18. The input device of claim 17, wherein said integrated circuit further comprises: four identical n-channel metal oxide semiconductor (NMOS) devices configured as source followers which provide matching voltages at their respective sources, wherein a source of a first of said four NMOS devices is coupled to said collector of said second BJT, a source of a second of said four NMOS devices is coupled to a collector of said fourth BJT, a source of a third of said four NMOS devices is coupled to a collector of said fifth BJT, and a source of a fourth of said four NMOS devices is coupled to a collector of said sixth BJT.

* * * * *